US007692624B2

(12) United States Patent
Liu et al.

(10) Patent No.: US 7,692,624 B2
(45) Date of Patent: Apr. 6, 2010

(54) LIQUID CRYSTAL DISPLAY, METHOD FOR DISPLAYING COLOR IMAGES, AND METHOD FOR CONTROLLING LIGHT SOURCES OF AN LCD PANEL

(75) Inventors: Chun-Ting Liu, Hsinchu (TW); Chih-Wei Wang, Hsinchu County (TW); Chin-Der Wey, Miaoli County (TW); Ya-Yun Yu, Taipei County (TW)

(73) Assignee: AU Optronics Corp., Hsin-Chu (TW)

( * ) Notice: Subject to any disclaimer, the term of this patent is extended or adjusted under 35 U.S.C. 154(b) by 929 days.

(21) Appl. No.: 11/419,753

(22) Filed: May 22, 2006

(65) Prior Publication Data

US 2007/0229444 A1 Oct. 4, 2007

(30) Foreign Application Priority Data

Mar. 29, 2006 (TW) ..... 95111006 A

(51) Int. Cl.
*G09G 3/36* (2006.01)

(52) U.S. Cl. ..... 345/102

(58) Field of Classification Search ..... 345/88, 345/96, 102

See application file for complete search history.

(56) References Cited

U.S. PATENT DOCUMENTS 4,257,045 A * 3/1981 Miles ..... 340/784
4,716,403 A * 12/1987 Morozumi ..... 345/88
6,867,757 B1 3/2005 Nakamura
6,894,668 B2 * 5/2005 Mi et al. ..... 345/87
2003/0016198 A1 1/2003 Nagai
2005/0200582 A1 9/2005 Goto et al.
2005/0248524 A1 * 11/2005 Feng et al. ..... 345/102
2006/0152468 A1 7/2006 Ozaki
2007/0024772 A1 * 2/2007 Childers et al. ..... 349/68

FOREIGN PATENT DOCUMENTS

CN 1265506 A 9/2000
CN 1667686 A 9/2005
CN 1228753 C 11/2005
CN 1701350 A 11/2005
JP 7-143285 6/1995

* cited by examiner

*Primary Examiner*—Amr Awad
*Assistant Examiner*—Tony Davis
(74) *Attorney, Agent, or Firm*—Winston Hsu

(57) ABSTRACT

A liquid crystal display includes a plurality of light sources of different colors and a control device. The control device is used to control the light sources to emit light with different duty cycles. Through persistence of vision, light generated by the light sources will form an image of desired colors. White balance can be achieved by controlling the duty cycles.

4 Claims, 11 Drawing Sheets

LIQUID CRYSTAL DISPLAY, METHOD FOR DISPLAYING COLOR IMAGES, AND METHOD FOR CONTROLLING LIGHT SOURCES OF AN LCD PANEL

BACKGROUND OF THE INVENTION

1. Field of the Invention

The present invention relates to a liquid crystal display (LCD) and related methods for operations of displays, and more particularly, to an LCD having a plurality light sources of different colors sequentially emitting light within different duty cycles and related methods for operations of displays.

2. Description of the Prior Art

Since a liquid crystal display (LCD) has the advantage of low operating voltage and low power consumption, it has a great potential to replace the conventional, cumbersome cathode ray tube terminal (CRT).

Refer to FIGS. 1 and 2. FIG. 1 is a schematic diagram of an LCD panel 2 of the prior art, and FIG. 2 is a schematic diagram of a back light source 3 and a pixel 20 of the LCD panel 2. The conventional liquid crystal display comprises an LCD panel 2, and a back light source 3. The LCD panel 2 has a plurality of pixels 20, each constituted by red, green, and blue sub-pixels, each sub-pixel embedded with red, green, or blue color filters 21, 22, or 23, respectively. The back light source 3 emits white light in general. The white light emitted from the back light source 3 is filtered by the color filters 21-23 for being converted into light of red, blue, and green colors.

The liquid crystal in every sub-pixel is controlled by scan signals and data signals. Red light, green light, and blue light are generated in different brightness at the same time through a corresponding color filter 21-23 in the corresponding sub-pixels. The red light, the green light, and the blue light are mixed to form colors that a human can recognize. To prevent optical interfere between the emitting light through different color filters 21-23 from the back light source 3, a black matrix (BM) should be disposed between the different color filters 21-23.

However, the arrangement of black matrixes will reduce the aperture ratio, the utility rate of the light source, and light efficiency, and increase the energy consumption. Therefore, emitting light of different colors in different time frames has been taught. Refer to FIG. 3. As shown in FIG. 3, a time frame is divided into three durations, in which red light, green light, and blue light are emitted, respectively. Through persistence of vision, the red light, green light, and blue light will form a desired color, rather than three separate colors.

Human can be affected by full-color images without any color filters according to the method of emitting light of different colors in different time frames, a.k.a., the method of color sequence. Compared to liquid crystal display with color filters, a display without any color filters increases resolution and aperture ratio three fold, saves manufacturing cost of a color filter, and offers reduced power consumption.

However, as shown in FIG. 3, which is a timing chart showing light sources of different colors emitting with the same duty cycles within different durations according to the prior art, every duration (duty cycle) for emitting different colors is the same. When the white light, formed by red light, green light, and blue light in this method, is not within a tolerance of a standard point on a Commission Internationale del'Eclairage (CIE) chart, it is not easy to adjust the mixed white light to become standard.

SUMMARY OF THE INVENTION

This invention provides a liquid crystal display comprising a plurality of light sources of different colors and a control device. The control device controls the light sources of different colors to emit light in different time frames with different duty cycles. Through persistence of vision, the light generated by the light sources will form an image of desired colors. White balance can be achieved by controlling the duty cycles.

Also provided is a method for displaying color images, comprising in a first time frame, a light source with a first color emitting for a first duration; and in a second time frame, a light source with a second color emitting for a second duration; wherein the first time frame does not overlap with the second time frame, and the first duration is different from the second duration. Through persistence of vision, the light generated by the light sources will form an image of desired colors. White balance can be achieved by controlling the duty cycles.

In addition, provided is a method for controlling a light source of an LCD panel, comprising controlling duty cycles of a plurality of light sources in an LCD panel according to hues of light generated by the light sources.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
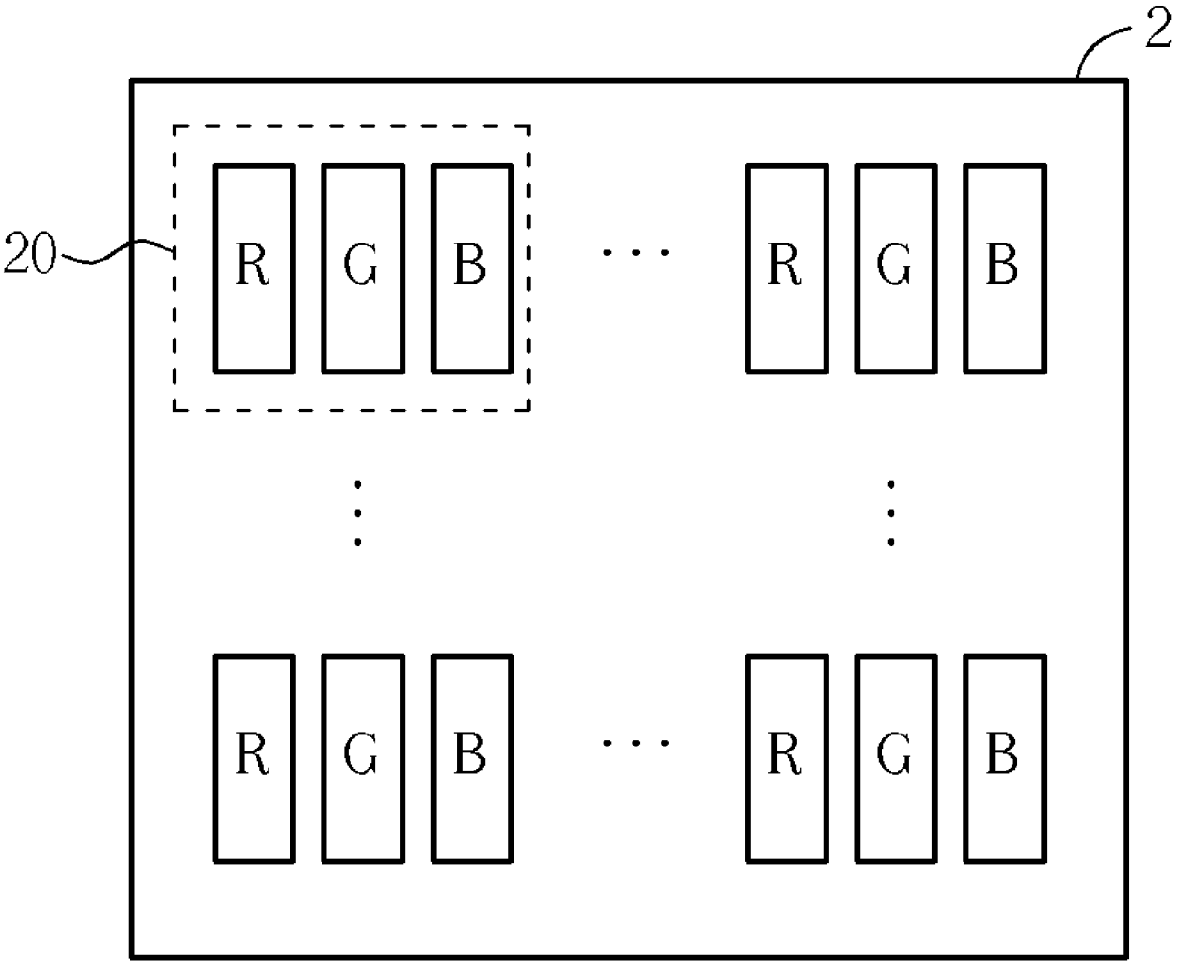
Fig. 1 Prior art
FIG. 1 is a schematic diagram of an LCD panel of the prior art.
Figure 2:
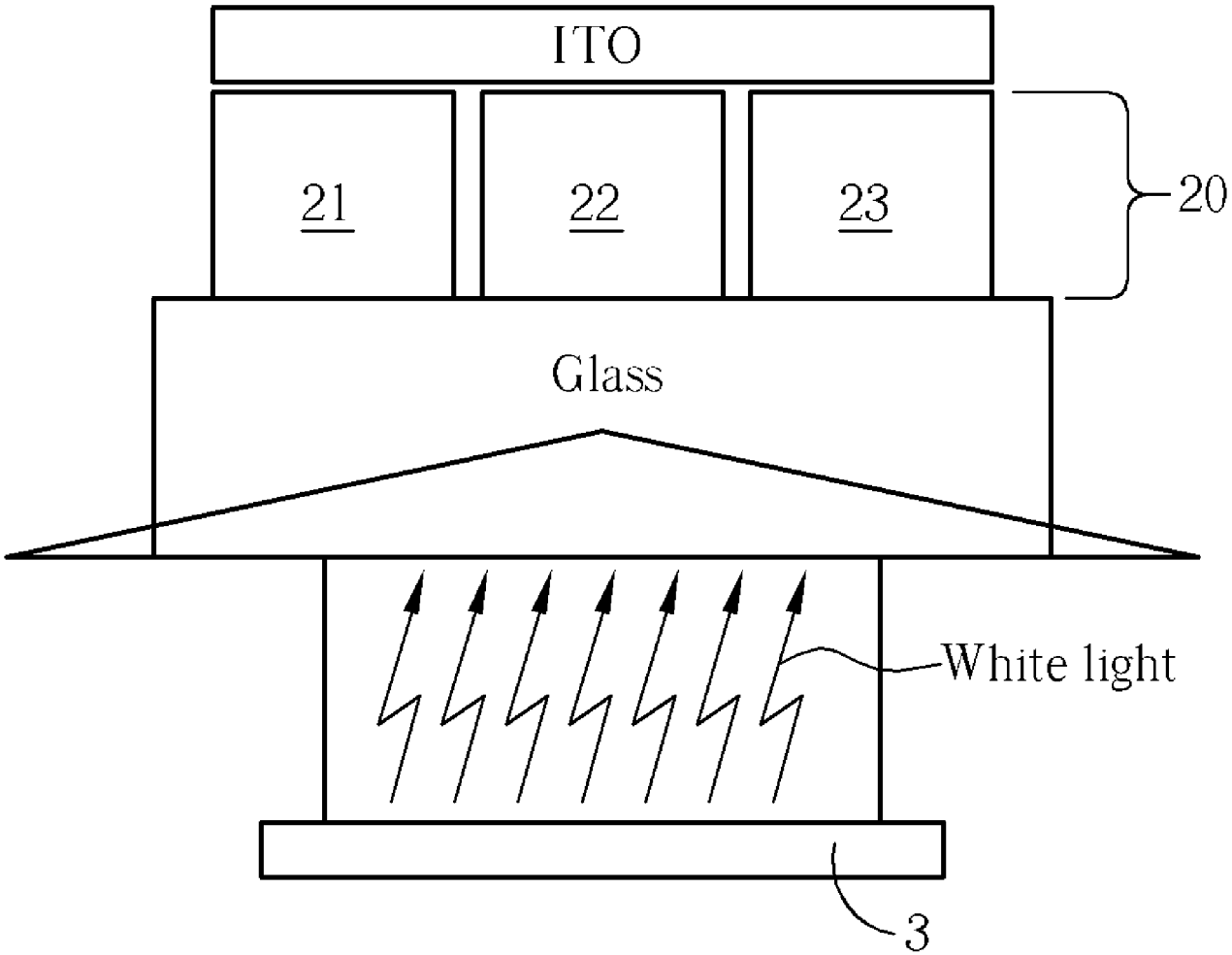
Fig. 2 Prior art
FIG. 2 is a schematic diagram of a back light source and a pixel of the LCD panel shown in FIG. 1.
Figure 3:
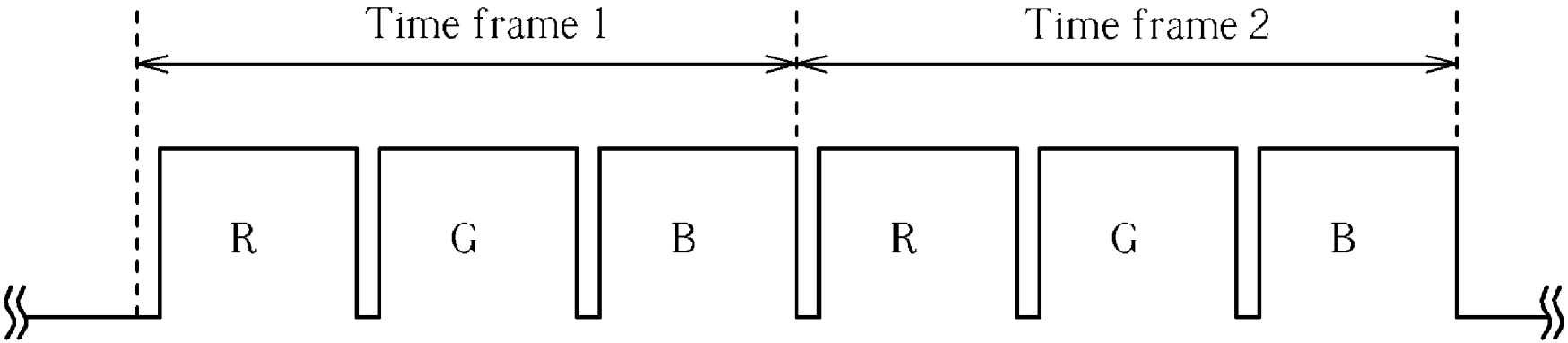
Fig. 3 Prior art
FIG. 3 is a timing chart showing light sources of different colors emitting with the same duty cycle within different durations in the prior art.
Figure 4:
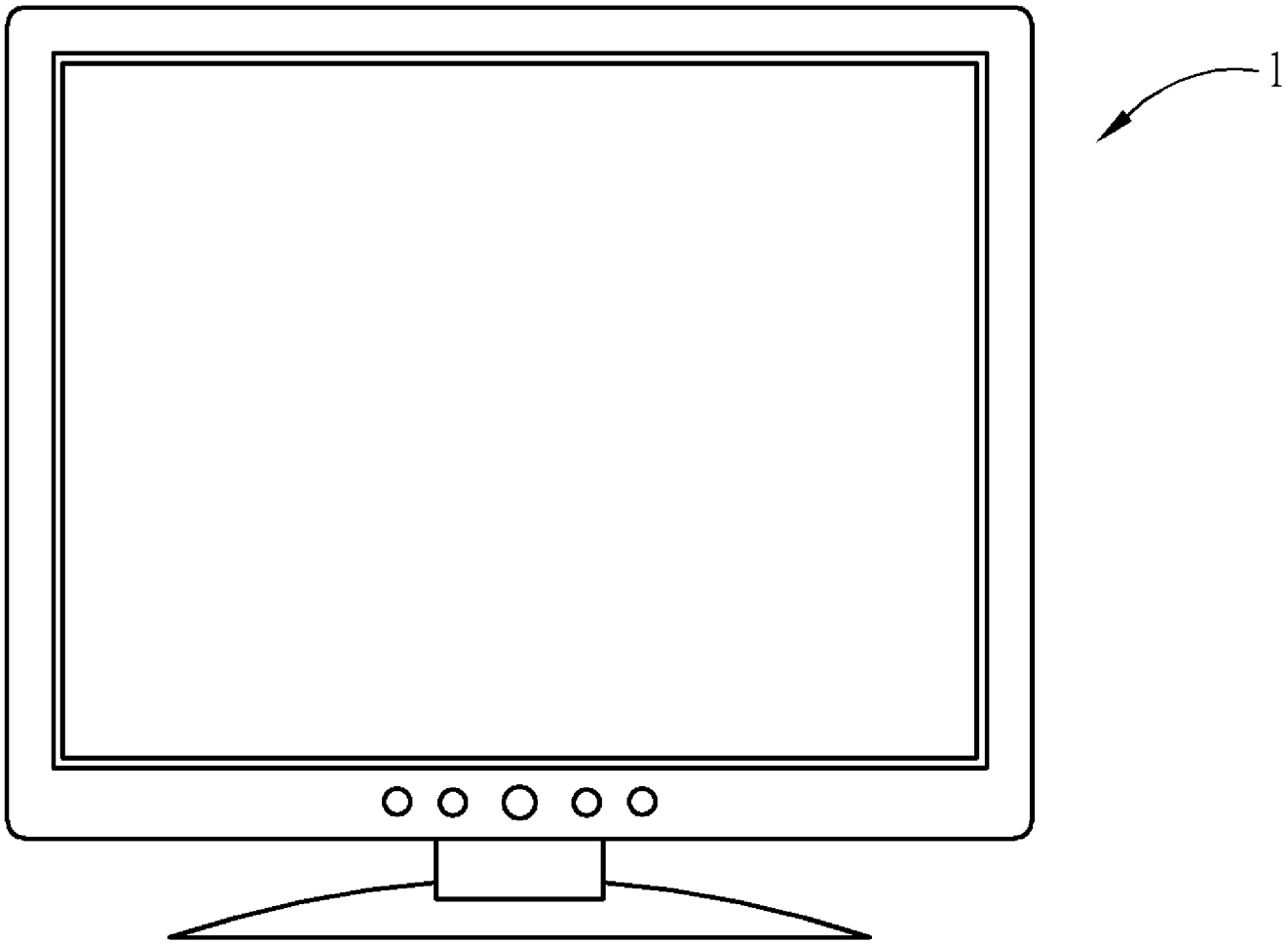
FIG. 4 is a schematic diagram of a liquid crystal display according to the present invention.
Figure 5:
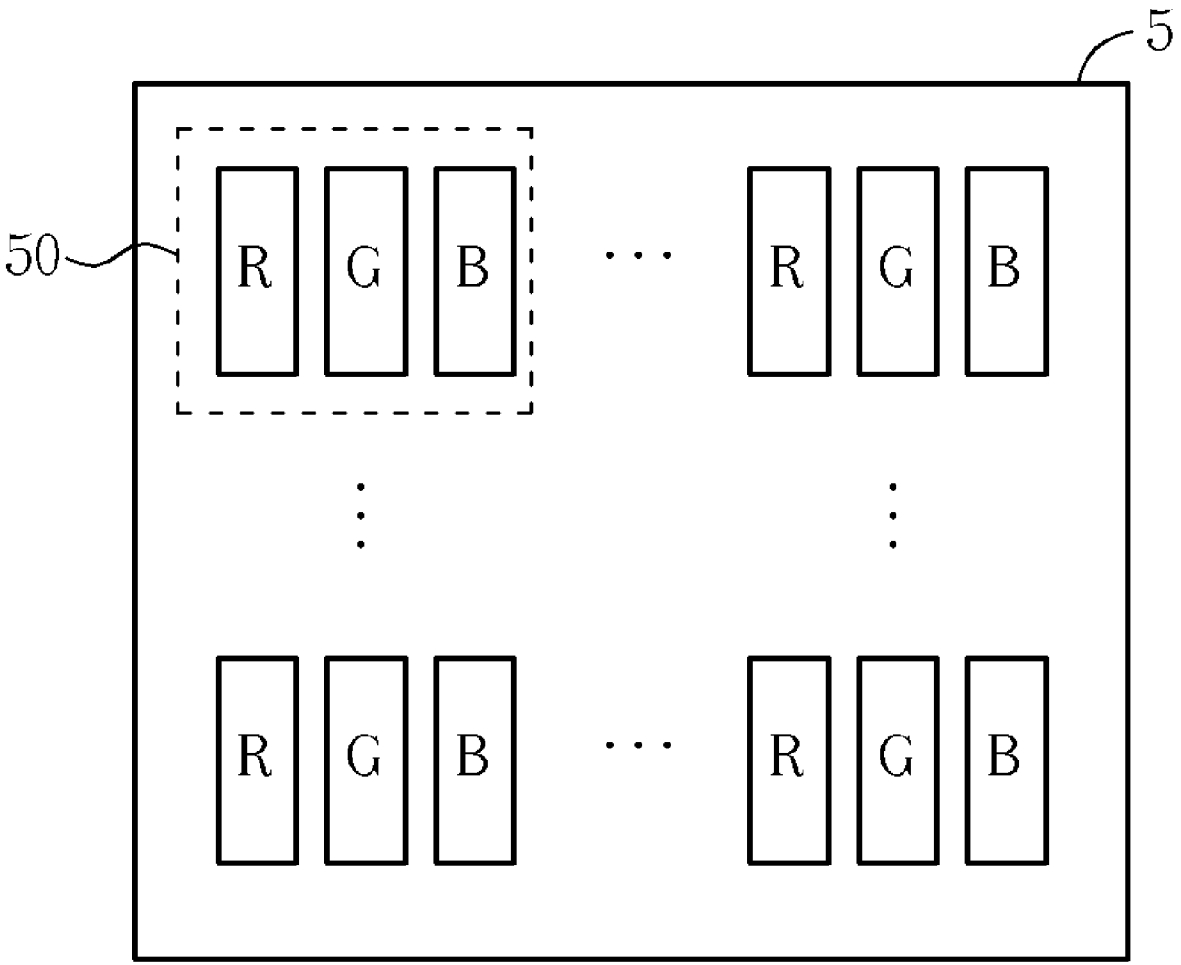
FIG. 5 is a schematic diagram showing a displaying method for the liquid crystal display according to the present invention.
Figure 6:
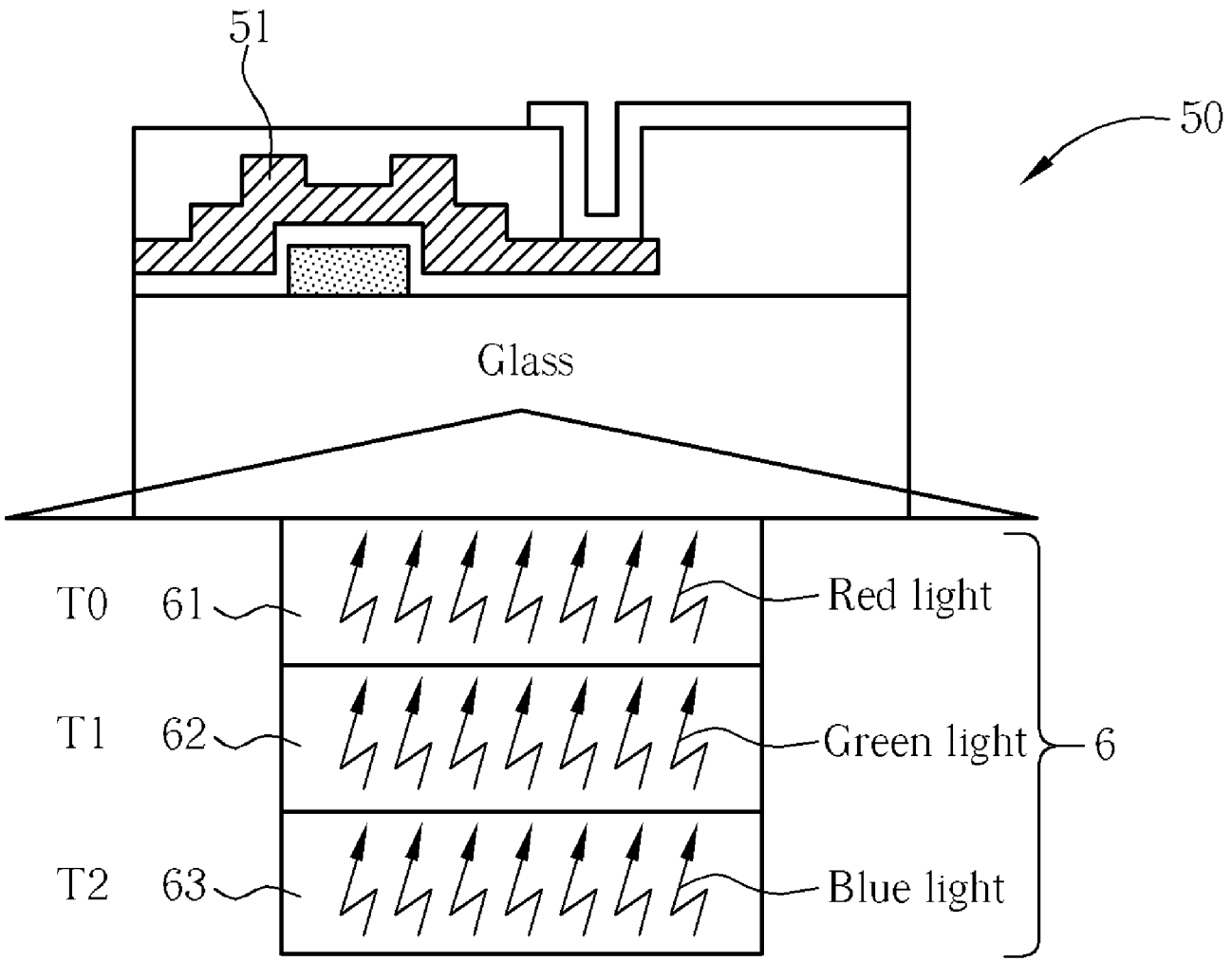
FIG. 6 shows a displaying method for every pixel shown in FIG. 5.

FIG. 4 is a schematic diagram of a liquid crystal display 1 according to the present invention. FIG. 5 is a schematic diagram showing a displaying method in the liquid crystal display according to the present invention. FIG. 6 shows a displaying method of every pixel shown in FIG. 5. Refer to FIGS. 5-6. As shown in the diagrams, the liquid crystal display 1 according to the present invention comprises a backlight module 6 and an LCD panel 5.

The backlight module 6 has a plurality of light sources of different colors. In this embodiment, the light sources comprise a red light source 61, a green light source 62, and a blue light source 63. However, the light sources can include two light sources of different colors, such as a blue light source and an orange light source. The backlight module 6 further has a control device controlling light sources of different colors to emit in different time frames with different duty cycles.

A plurality of pixels 50 are formed on a surface of the LCD panel 5. Each pixel 50 has at least one thin film transistor (TFT) 51 controlling the brightness of the corresponding colors. When the TFT 51 receives a scan signal and a data signal, a liquid crystal will rotate to block light so that brightness of the light sources of different colors can be different. Through persistence of vision, the light generated by the light sources will form an image of desired colors. A desired color can be standard white light on the CIE chart.

Figure 7:
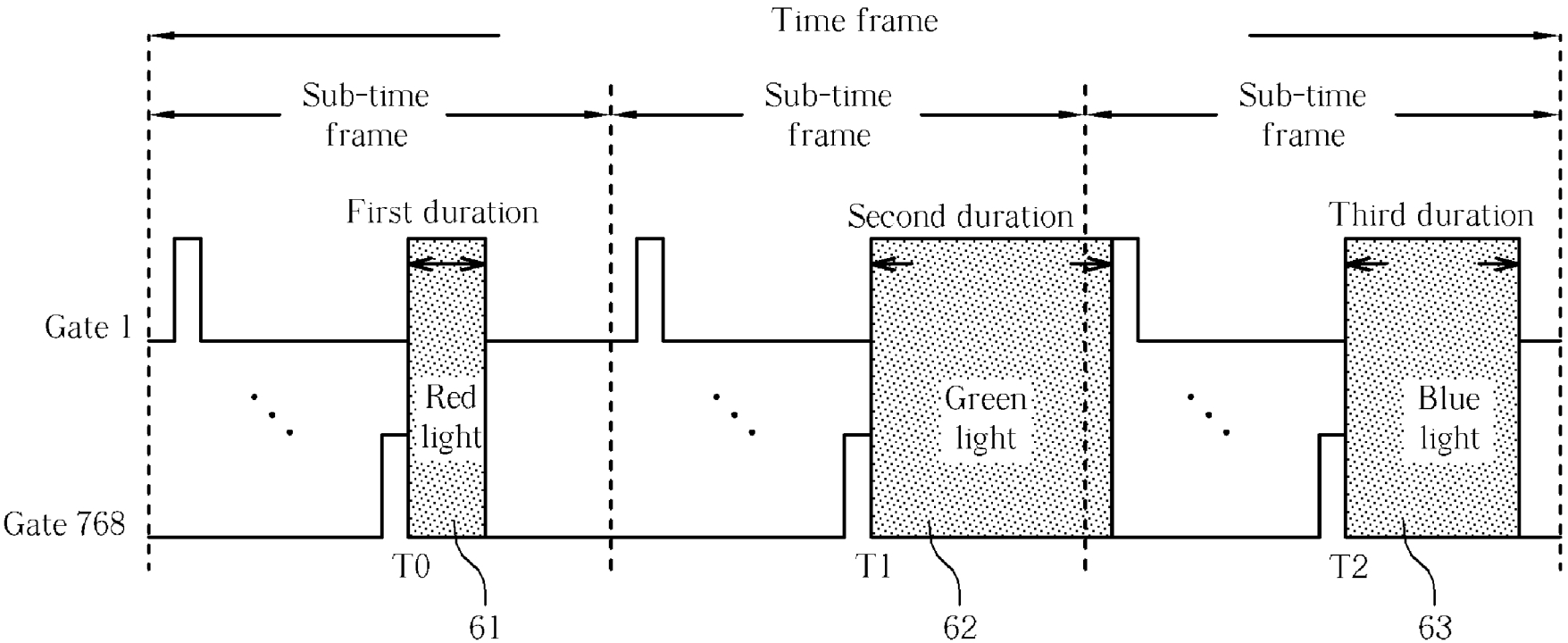
FIGS. 7-11 are timing charts showing light sources of different colors emitting in different duty cycles within different durations according to the present invention.

FIGS. 7-11 are timing charts showing light sources of different colors emitting in different duty cycles within different durations, controlled by the above-mentioned control device. FIG. 7 shows the first embodiment according to the present invention. As shown in FIG. 7, the time frame is divided into three sub-time frames for emitting light from the red light source 61, the green light source 62, and the blue light source 63, respectively.

For example, if the number of the pixels is 1280×768, at the beginning of the first sub-time frame, the liquid crystals of the 768 rows will receive a signal in sequence to determine the rotation of the corresponding liquid crystals of the red light based on the scan signal and the data signal. Then, the red light source 61 emits red light in the first duration. Next, at the beginning of the second sub-time frame, the liquid crystals of the 768 rows will receive a signal in sequence to determine the rotation of the corresponding liquid crystals of the green light based on the scan signal and the data signal. Then, the green light source 62 emits green light in the second duration. At the beginning of the third sub-time frame, the liquid crystals of the 768 rows will receive a signal in sequence to determine the rotation of the corresponding liquid crystals of the blue light based on the scan signal and the data signal. Then, the blue light source 63 emits blue light in the third duration.

Particularly, the three durations are not all the same, i.e., the lengths of the first duration, the second duration, and the third duration are not all the same. Because the emitting durations are very close, light generated by the light sources will form an image of desired colors through persistence of vision. Therefore, it is easy to achieve white balance by controlling the individual duration (duty cycle).

Figure 8:
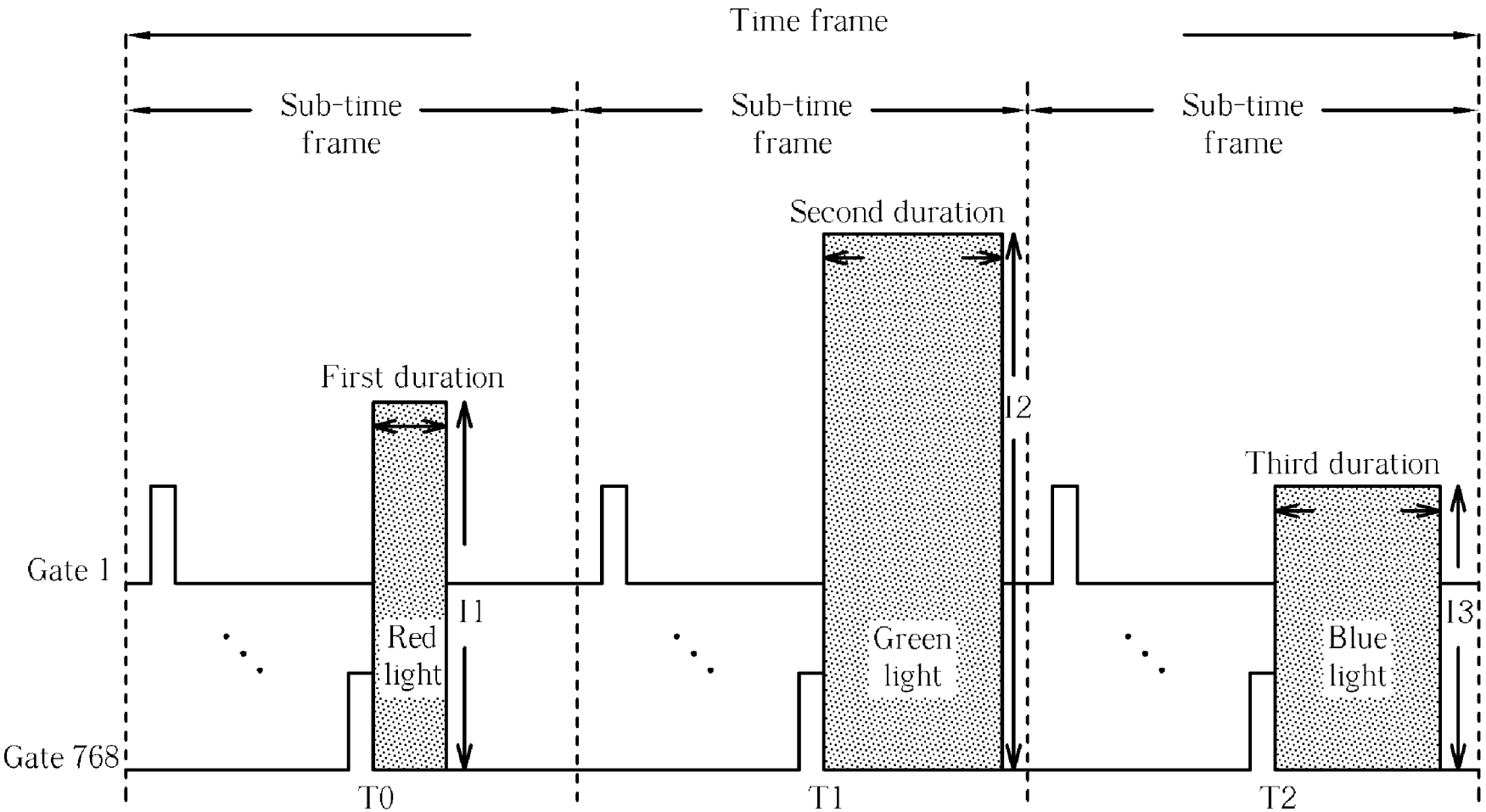

FIG. 8 is the second embodiment according to the present invention. As shown in FIG. 8, the first duration, the second duration, and the third duration are not all the same. In addition, the brightness (intensity) of the light sources can also be different. As shown in FIG. 8, the brightness of the green light source is the brightest, the brightness of the red light source is second, and the brightness of the blue light source is the darkest.

Figure 9:
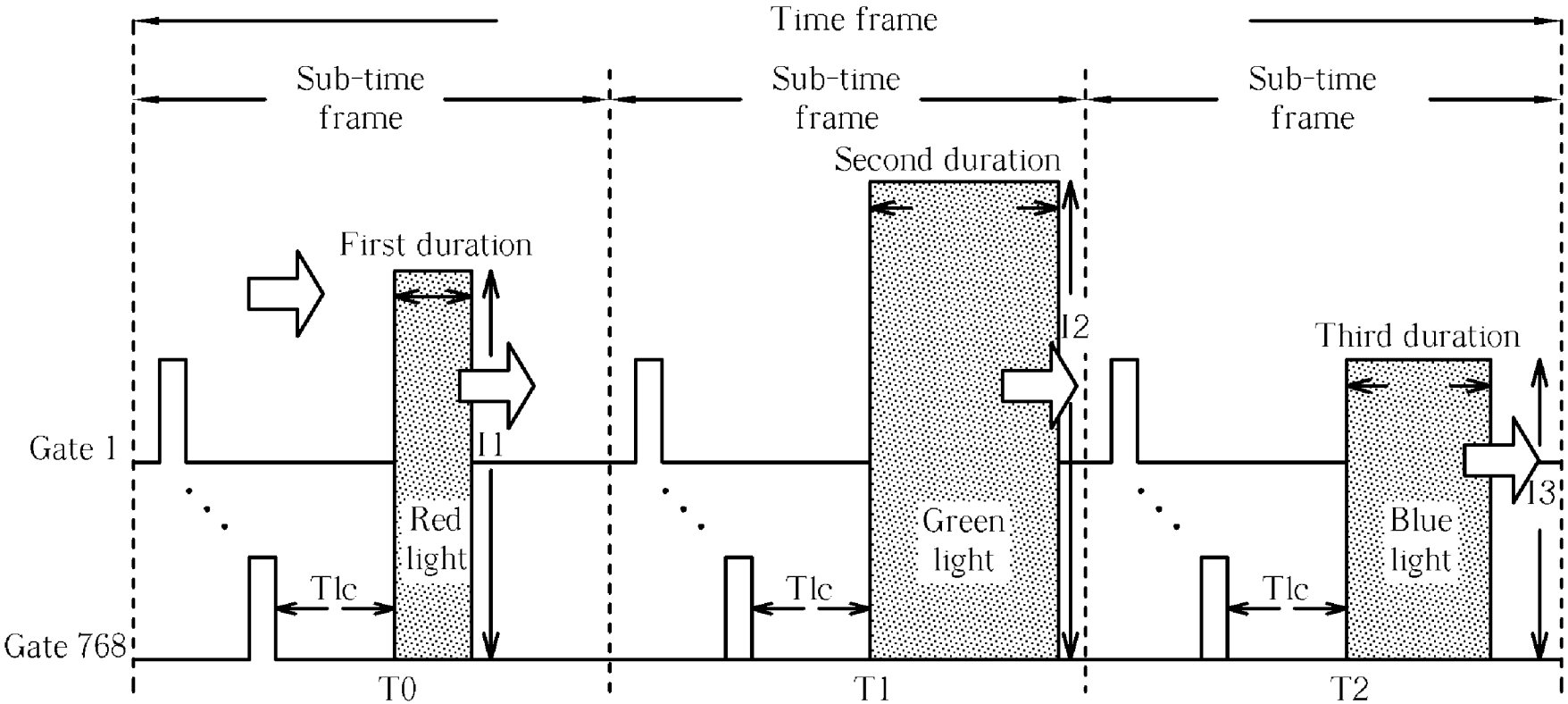

FIG. 9 shows the third embodiment according to the present invention. As shown in FIG. 9, the first duration, the second duration, and the third duration are not all the same. In addition, the beginning of each duration follows the input period for inputting the signal to determine the rotation of the corresponding liquid crystal and the rotating period (response time) of the liquid crystal (Tlc). Also, the brightness of the light sources of different colors can be different.

Figure 10:
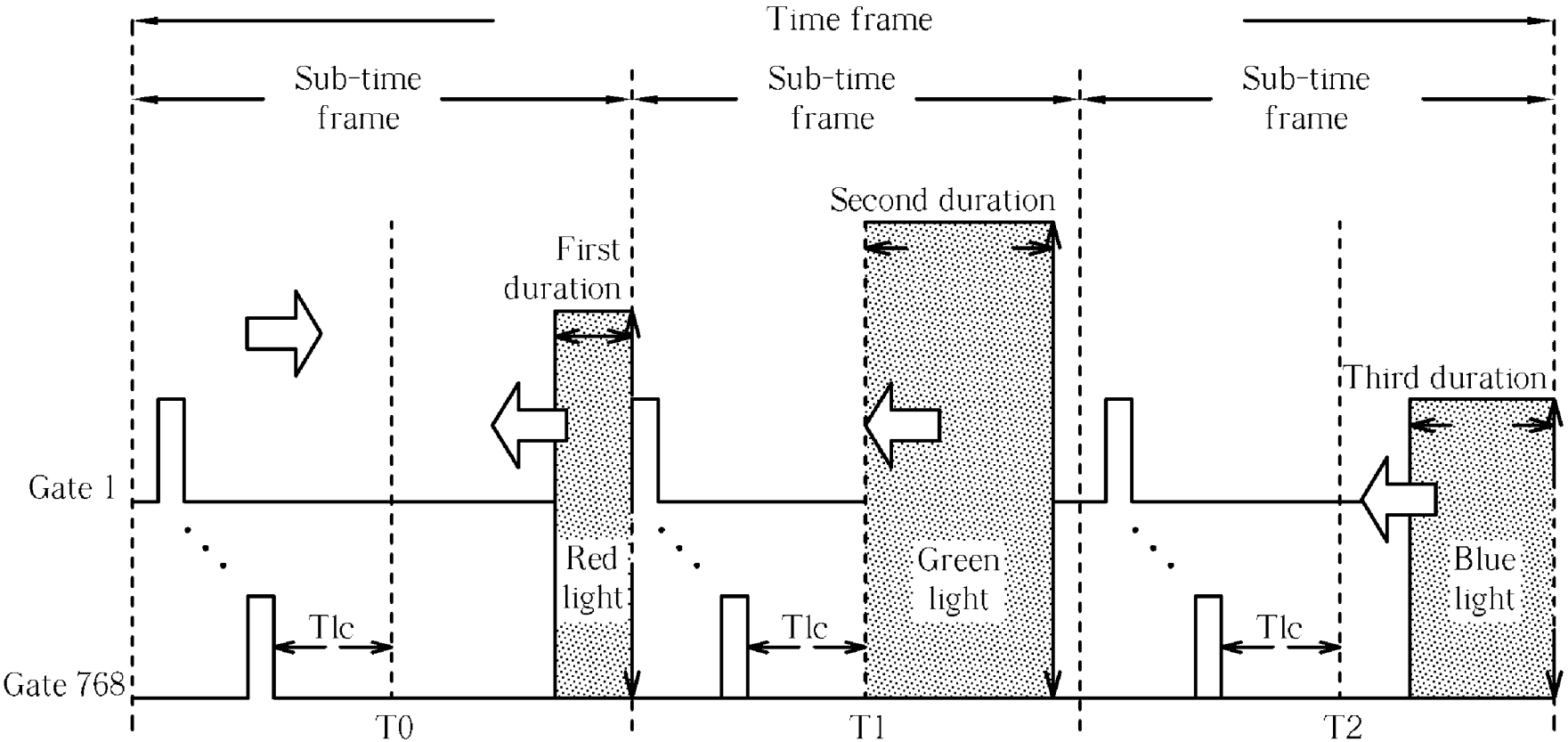

FIG. 10 shows the fourth embodiment according to the present invention. As shown in FIG. 10, the first duration, the second duration, and the third duration are not all the same. In addition, the end of each duration is followed by the beginning of the next sub-time frame. Also, the brightness of the light sources of different colors can be different.

Figure 11:
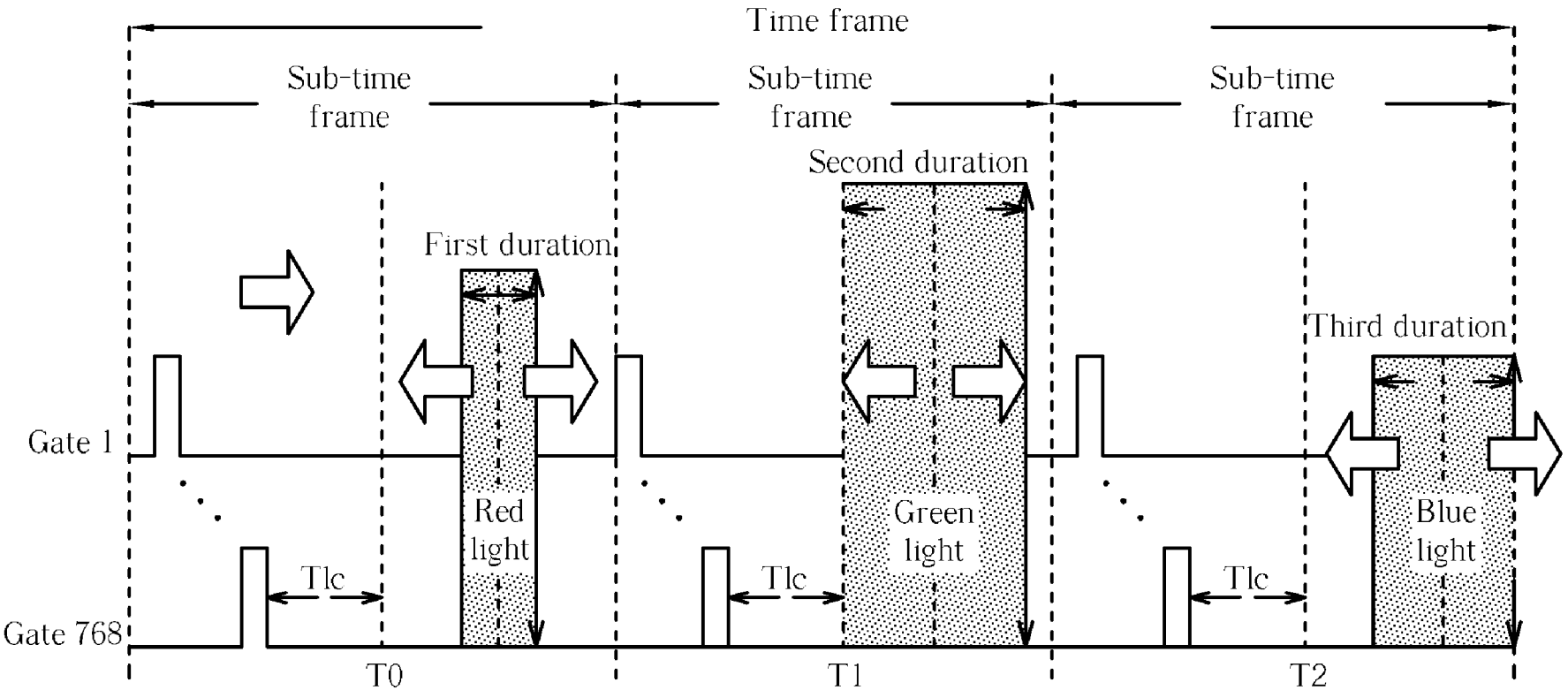

FIG. 11 shows the fifth embodiment according to the present invention. As shown in FIG. 11, the first duration, the second duration, and the third duration are not all the same. In addition, the middle point of each duration is the middle point of the period from the end of the rotating period of the correspond liquid crystal to the beginning of the next sub-time frame.

A method for controlling light sources of an LCD panel is also provided. The method comprises controlling the duty cycles of a plurality of light sources in an LCD panel according to the hues of the light generated by the light sources.

In conclusion, unlike the prior art, in which the emitting time of each color is the same and in which it is not easy to adjust the mixed color to be standard white light, in the present invention, it is much easier to form an image of desired colors, and white balance can be achieved by controlling the duty cycles of the light sources.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for displaying a color image, comprising:

in a first sub-time frame, emitting light with a first color for a first duration;

in a first input period of the first sub-time frame, inputting a first signal to determine an extent of rotation of a corresponding liquid crystal, wherein the first input period precedes the first duration and does not overlap with the first duration;

after the first input period and before the first duration, rotating the corresponding liquid crystal according to the first signal in a first rotating period of the liquid crystal; and in a second sub-time frame, emitting light with a second color for a second duration; wherein the first sub-time frame does not overlap with the second sub-time frame, and the first duration is different from the second duration;

wherein a middle point of the first duration is a middle point of a period from an end of the first rotating period of the liquid crystal to a beginning of the second sub-time frame.

2. The method of claim 1, further comprising:

in a third sub-time frame, emitting light with a third color for a third duration;

wherein the third sub-time frame does not overlap with either the first sub-time frame or the second sub-time frame, and the third duration is different from the second duration and the first duration.

3. The method of claim 1, further comprising:

in the third sub-time frame, emitting light with a third color for a third duration;

wherein the third sub-time frame does not overlap with either the first sub-time frame or the second sub-time frame, and the third duration is equal to the first duration.

4. The method of claim 1, wherein the first duration is followed by the second duration.

* * * * *